US008640822B2

(12) United States Patent
Schooler

(10) Patent No.: US 8,640,822 B2
(45) Date of Patent: Feb. 4, 2014

(54) EXHAUST MUFFLER

(76) Inventor: Lewis S. Schooler, Ephrata, WA (US)

( * ) Notice: Subject to any disclaimer, the term of this patent is extended or adjusted under 35 U.S.C. 154(b) by 0 days.

(21) Appl. No.: 13/564,386

(22) Filed: Aug. 1, 2012

(65) Prior Publication Data

US 2013/0199870 A1 Aug. 8, 2013

Related U.S. Application Data

(60) Provisional application No. 61/514,230, filed on Aug. 2, 2011.

(51) Int. Cl.
*F01N 13/18* (2010.01)

(52) U.S. Cl.
USPC ..... 181/282; 181/212; 181/264; 181/272

(58) Field of Classification Search
USPC ..... 181/282, 272, 264, 212
See application file for complete search history.

(56) References Cited

U.S. PATENT DOCUMENTS

| | | | | |
|---|---|---|---|---|
| 3,811,531 | A * | 5/1974 | Forssman | 181/258 |
| 4,809,812 | A * | 3/1989 | Flugger | 181/268 |
| 5,824,972 | A * | 10/1998 | Butler | 181/279 |
| 5,969,299 | A * | 10/1999 | Yamaguchi et al. | 181/227 |
| 6,089,347 | A * | 7/2000 | Flugger | 181/264 |
| 6,364,054 | B1 * | 4/2002 | Bubulka et al. | 181/264 |
| 6,622,821 | B2 * | 9/2003 | Butler | 181/270 |
| 2005/0133301 | A1 * | 6/2005 | Butterfield et al. | 181/275 |

* cited by examiner

*Primary Examiner* — Forrest M Phillips
(74) *Attorney, Agent, or Firm* — Foster Pepper PLLC; Richard T. Black; P. G. Scott Born

(57) ABSTRACT

An exhaust muffler includes a pair of base members disposed substantially parallel to one another and defining an exhaust entry and exhaust exit. At least one wall member is coupled to the base members. The at least one wall member is intermediate the base members and intermediate the entry and exit. The at least one wall member includes a linear portion coupled to a semicircular portion.

8 Claims, 19 Drawing Sheets

EXHAUST MUFFLER

PRIORITY CLAIM

This application claims priority from U.S. Provisional Application No. 61/514,230 filed Aug. 2, 2011, which is hereby incorporated by reference in its entirety as if fully set forth herein.

BACKGROUND OF THE INVENTION

Current prior art mufflers generally include materials that are prone to rust, burn out, and deterioration in use. Thus, they must typically be replaced during the life of the vehicle. The current process for replacing existing mufflers is expensive. Moreover, the muffler being replaced is rusted and useless. These useless discarded mufflers overflow in junkyards and landfills. Therefore, there is a need for mufflers less prone to rust, burn out, and deterioration so that they are more durable and last longer, thereby saving consumers money, and reducing impact on the environment.

BRIEF DESCRIPTION OF THE DRAWING

The above and further advantages of the invention may be better understood by referring to the following description taken in conjunction with the accompanying drawings, in which.

DETAILED DESCRIPTION OF THE PREFERRED EMBODIMENT

Embodiments of the invention include a muffler with a J-Chambered design substantially completely constructed of sheet metal with no fiberglass, ceramic, or steel fibers to burn out over time. These embodiments of the muffler have a fully-welded construction and are preferably painted with a high-temperature ceramic coating inside and even more preferably, both inside and out. This enables the muffler to last longer and save the consumer money.

The muffler is preferably a performance muffler. The muffler can be made of smaller cases which can fit into tighter places and weigh less. The muffler can have a great deep tone at lower rpm levels and tend to open up with a great sounding high pitch tone at a higher rpm. The muffler has a J-side chamber design which can be made larger or smaller depending on level of sound desired (tuning chamber). The J-side chamber can be constructed to have little or no back pressure depending on the application for which it is intended. An embodiment can also have a heart-shaped J-chamber, which is preferably a low-pressure chamber that creates a scavenging affect to enhance performance (e.g., boost chamber).

Figure 1:
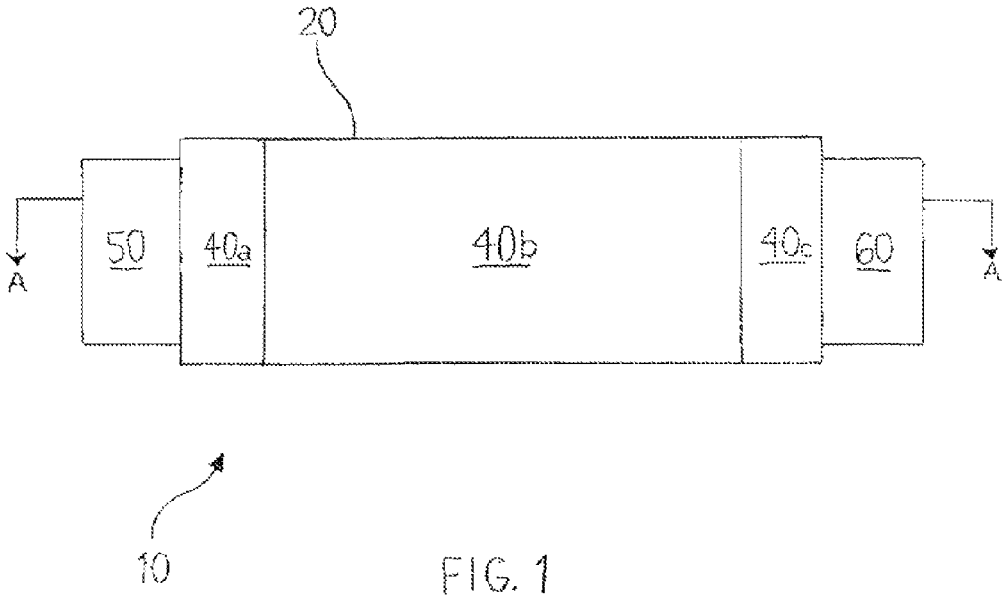
FIG. 1 illustrates a side view of a muffler according to an embodiment of the invention.
Figure 2:
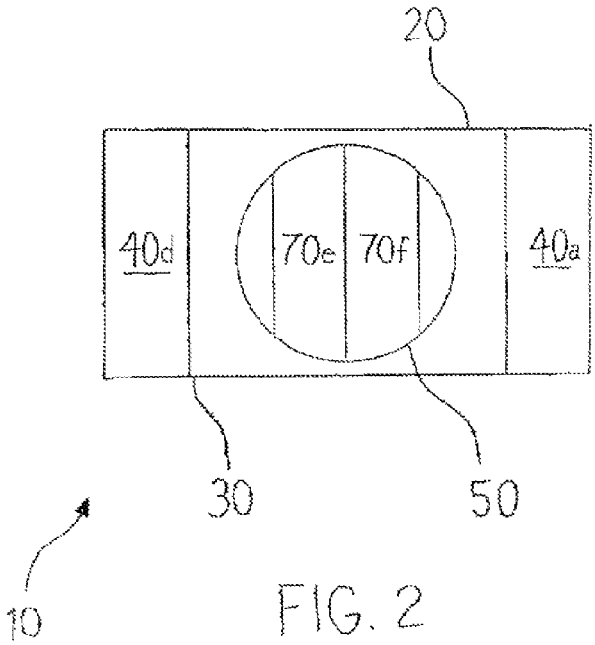
FIG. 2 illustrates a front view of the muffler of FIG. 1.
Figure 3:
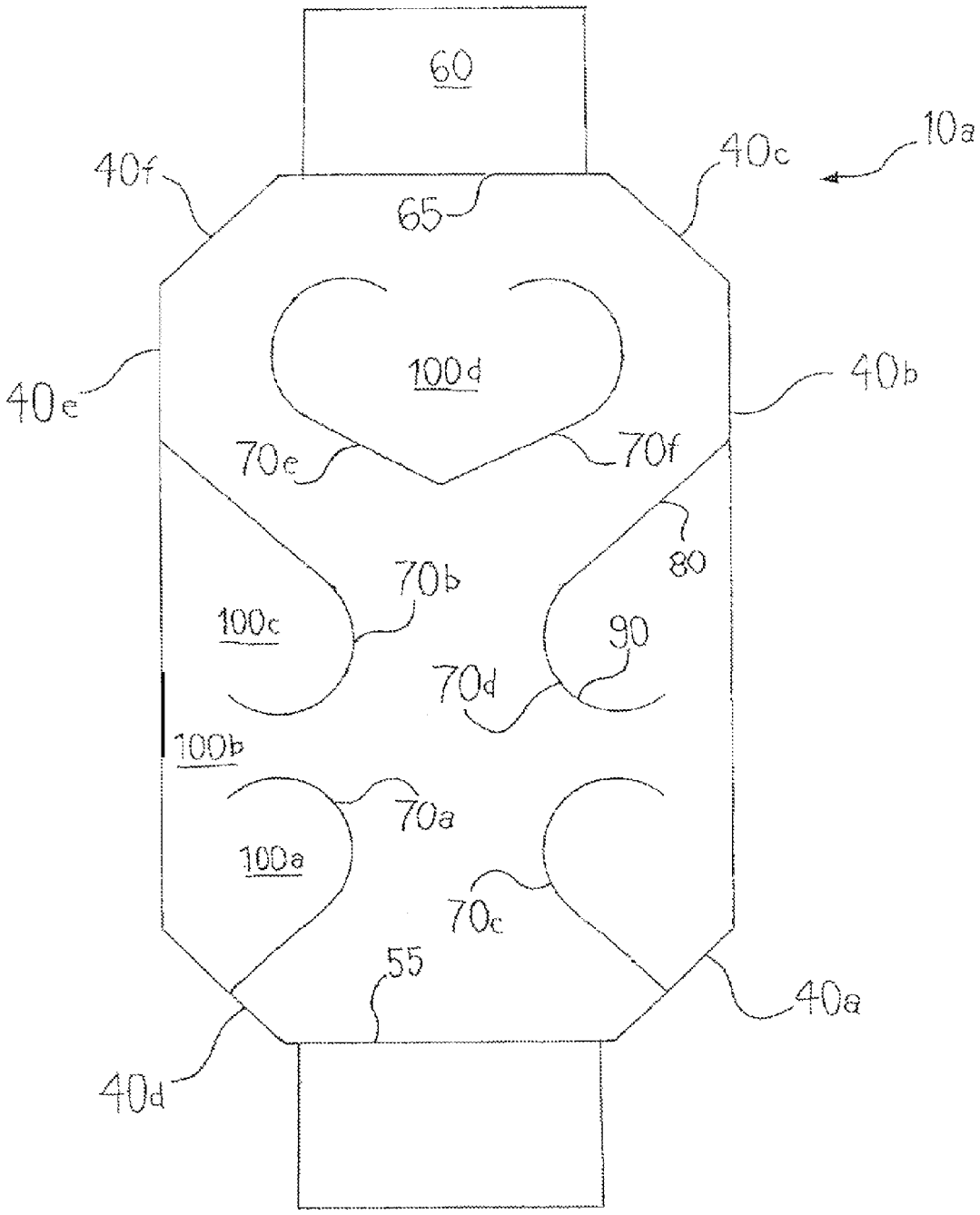
FIG. 3 is a top cross-sectional view of the muffler of FIG. 1 taken along line A-A thereof.
Figure 4:
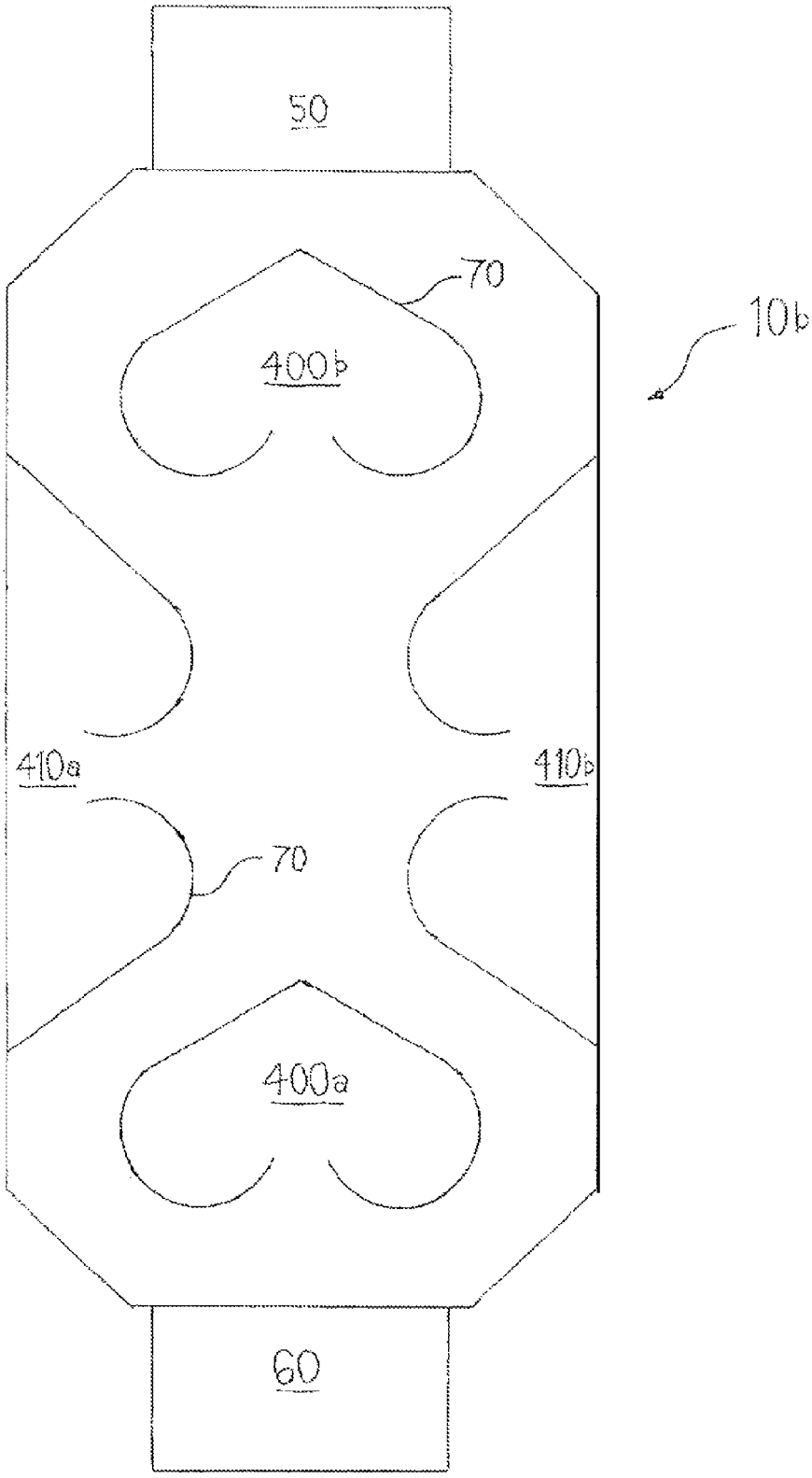
FIG. 4 is a top cross-sectional view of an alternative embodiment of the muffler of FIG. 1 taken along line A-A thereof.

Referring to FIGS. 1 and 2, an exhaust muffler 10, alternative embodiments 10*a*, 10*b* of which are respectively illustrated in greater detail in FIG. 3 and FIG. 4, includes a top base member 20 and a bottom base member 30. In the illustrated embodiment, muffler 10 further includes side surfaces 40*a-f* coupled to the base members 20, 30, as well as an exhaust entry port 50 and exhaust exit port 60. The base members 20, 30 are disposed substantially parallel to one another (i.e., a roof-floor relationship) and define an exhaust entry 55 and exhaust exit 65 respectively accessible to exhaust entry port 50 and exhaust exit port 60.

Referring now to FIG. 3, muffler 10*a* includes a plurality of wall members 70 coupled to the base members 20, 30. In an embodiment, the wall members 70 are intermediate the base members 20, 30 and intermediate the entry 55 and exit 65. Each wall member 70 includes, as best illustrated with reference to wall member 70*d*, a linear portion 80 having substantially no radius of curvature coupled to a semicircular portion 90 having a radius of curvature, such that each wall member 70, when viewed from above, resembles a hook or the letter "J."

The wall members 70 can be structurally and/or aerodynamically coupled to one another to form chambers 100 within muffler 10. For example, in one typical configuration according to an embodiment, wall members 70*a* and 70*b* project from one or more side surfaces (e.g., 40*d*, 40*e*) such that the semicircular portions 90 of wall members 70*a*, 70*b* are inclined toward each other to form, in cooperation with the side surfaces and base members 20, 30, at least one chamber 100 (e g , tuning chambers 100*a-c*).

In another typical configuration according to an embodiment, wall members 70*e* and 70*f* are positioned such that the semicircular portions 90 of wall members 70*e*, 70*f* are inclined away from each other to form, in cooperation with the base members 20, 30, at least one chamber 100 (e.g., boost chamber 100*d*), in such case substantially in the shape of a heart. In this configuration, the distal ends of the linear portions 80 of wall members 70*e*, 70*f* may be in close proximity to one another or contact each other to form a seal.

FIG. 4 shows an alternative embodiment in which wall members 70 are positioned to form boost chambers 400 and tuning chambers 410 in a manner similar to that illustrated in FIG. 3.

Figure 5:
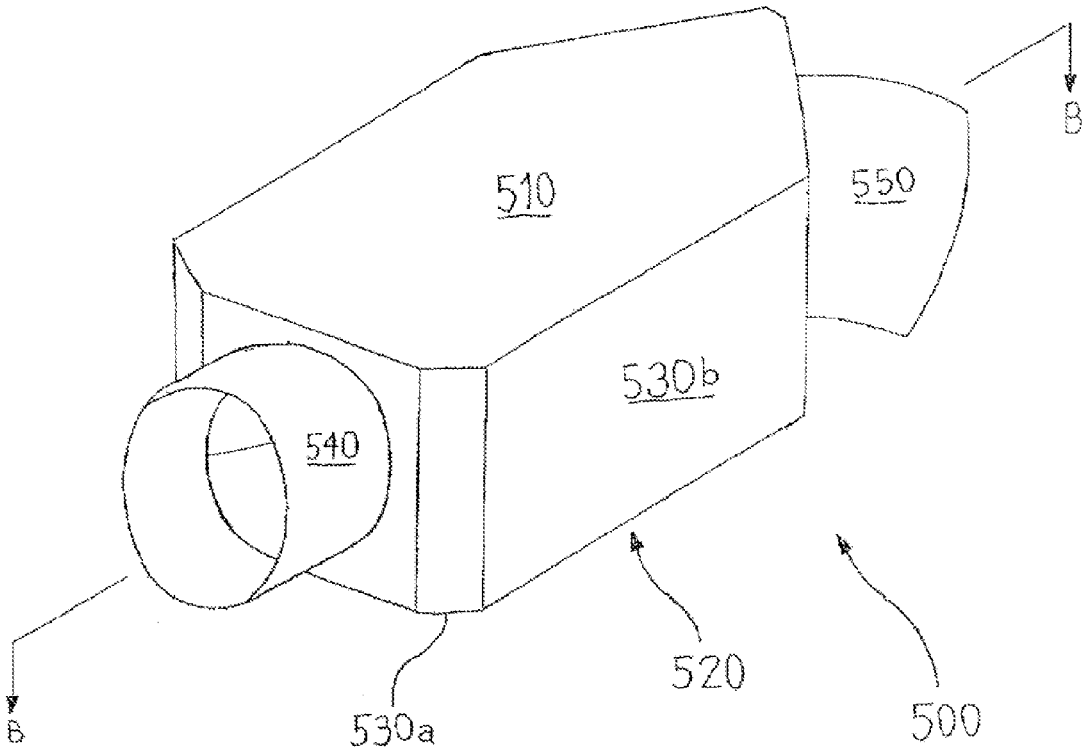
FIG. 5 is a top perspective view of a muffler according to an alternative embodiment of the invention.

Referring to FIG. 5, an exhaust muffler 500 according to an alternative embodiment includes a top base member 510 and a bottom base member 520. In the illustrated embodiment, muffler 500 further includes side surfaces 530*a-f* coupled to the base members 510, 520, as well as an exhaust entry port 540 and exhaust exit port 550. The base members 510, 520 are disposed substantially parallel to one another (i.e., a roof-floor relationship) and define an exhaust entry 555 and exhaust exit 565 respectively accessible to exhaust entry port 540 and exhaust exit port 550.

Figure 6:
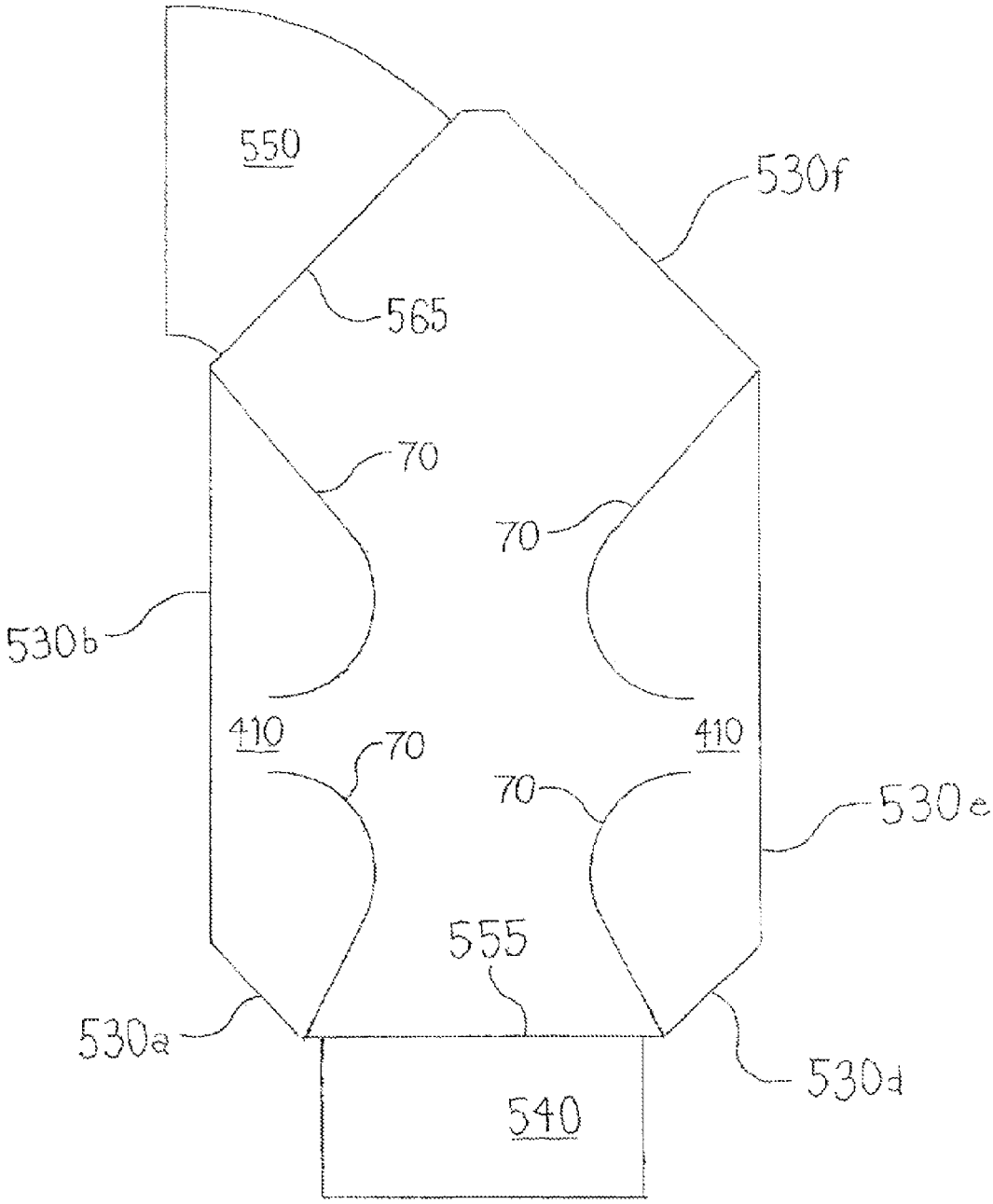
FIG. 6 is a top cross-sectional view of the muffler of FIG. 5 taken along line B-B thereof.
Figure 7:
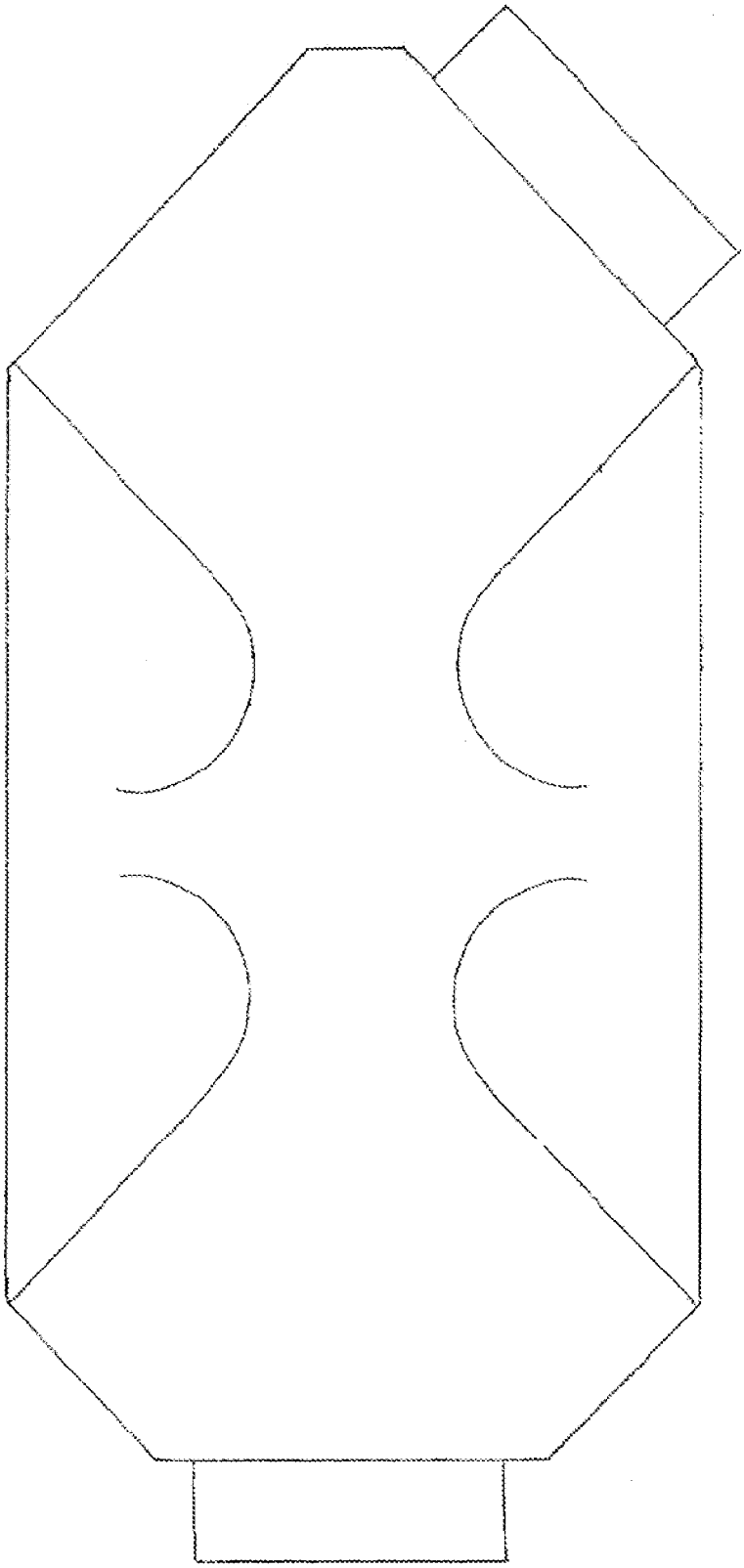
FIGS. 7-20 illustrate, in top cross-sectional view similar to that of FIGS. 3, 4 and 6, alternative embodiments of a muffler according to an embodiment of the invention.
Figure 8:
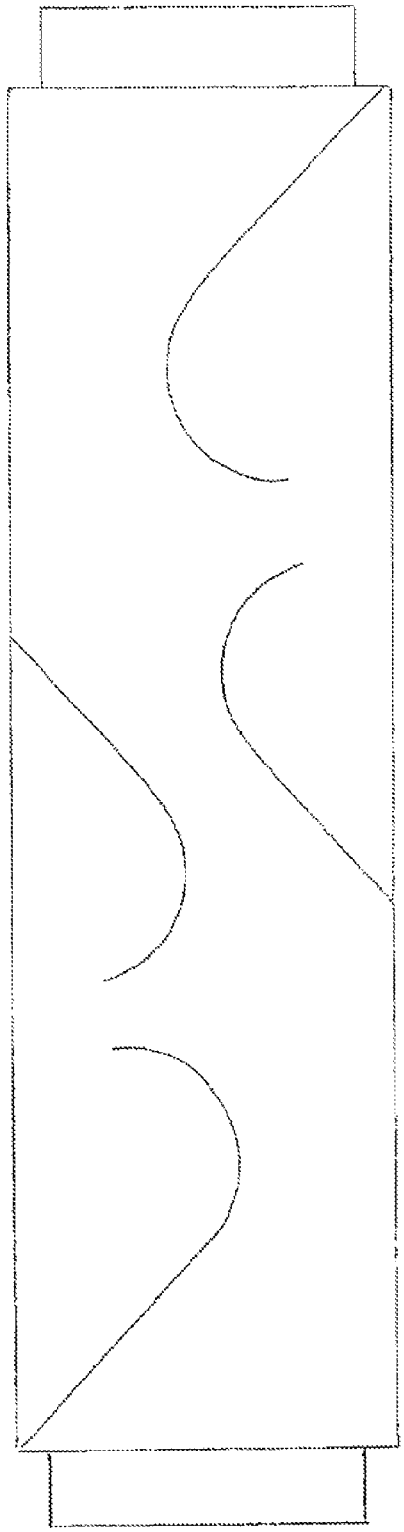
Figure 9:
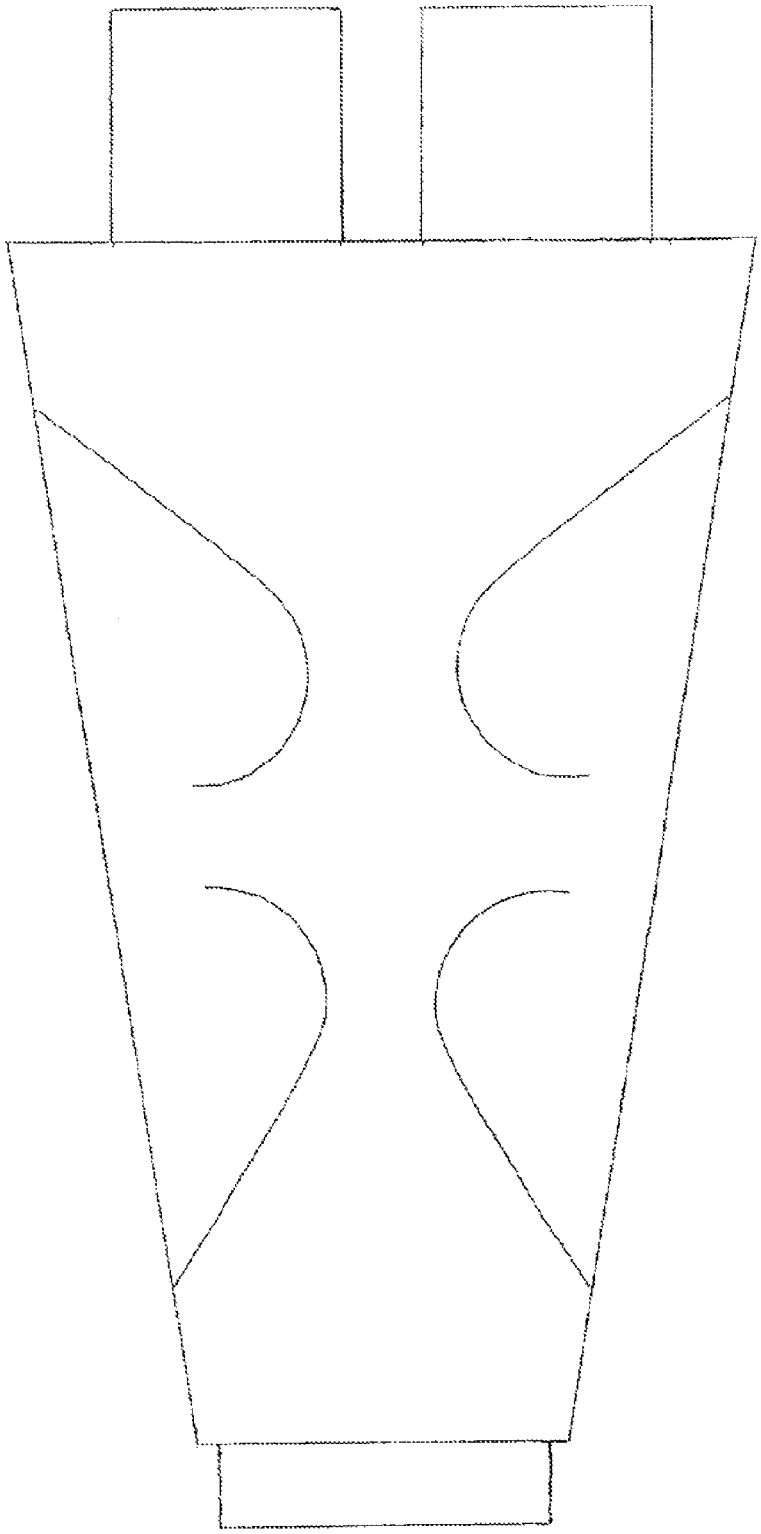
Figure 10:
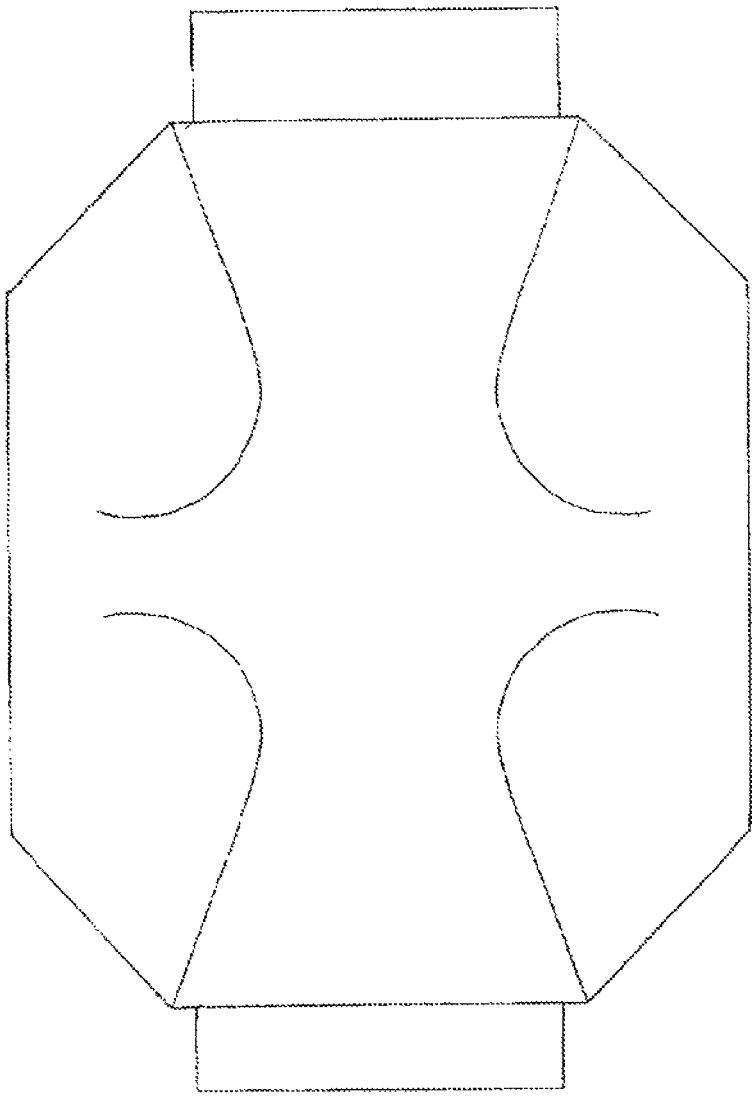
Figure 11:
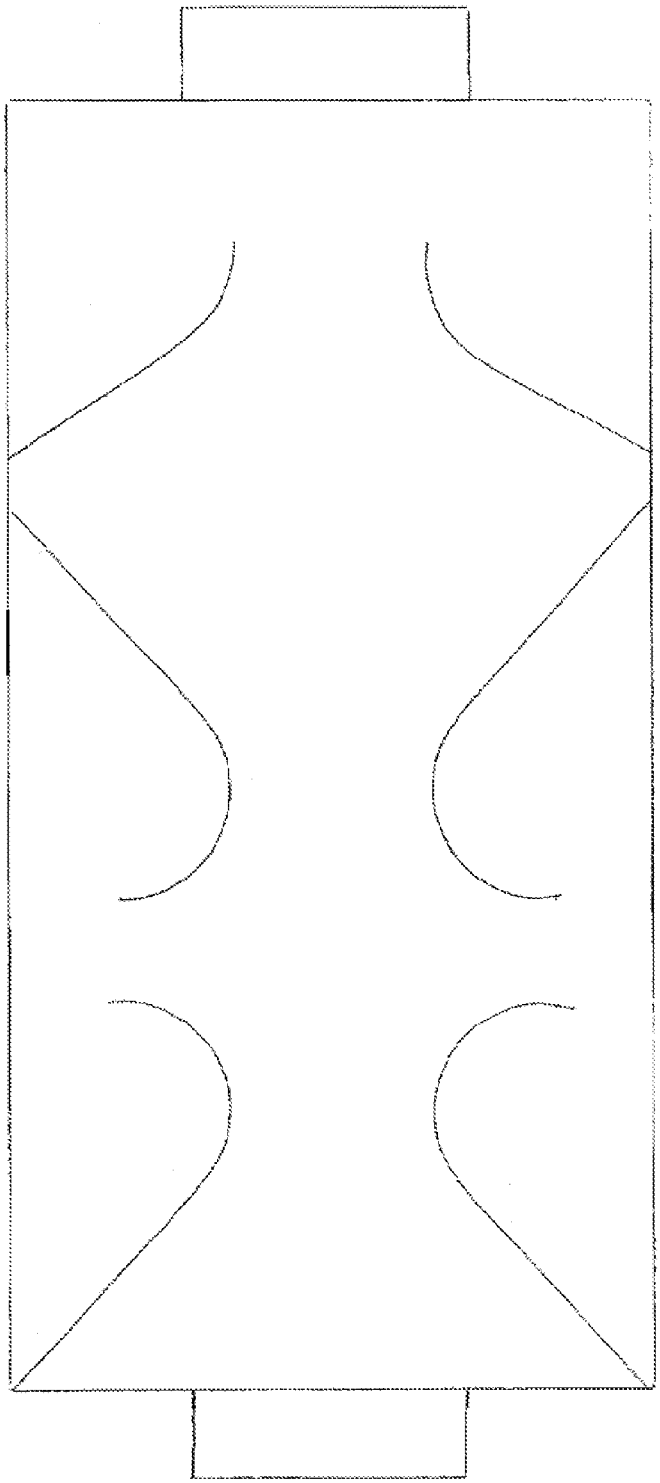
Figure 12:
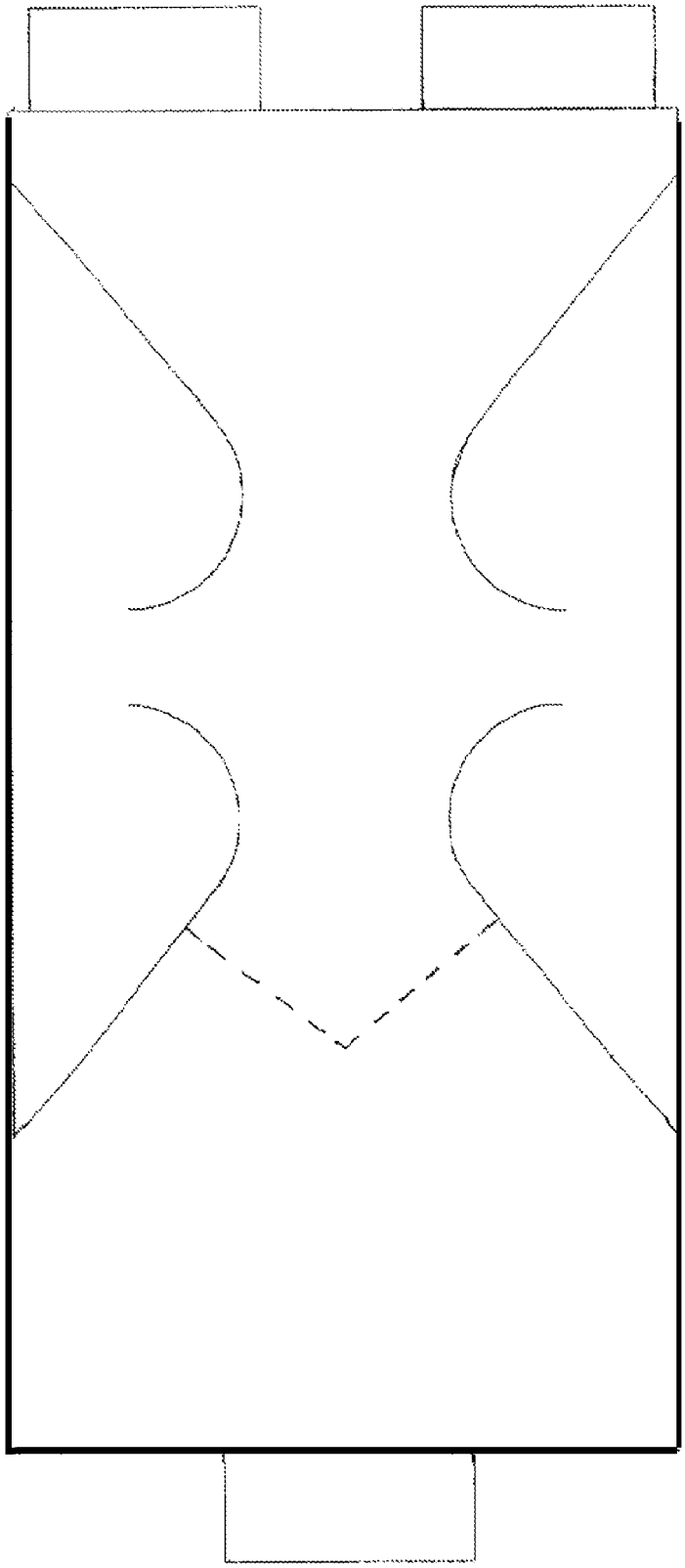
Figure 13:
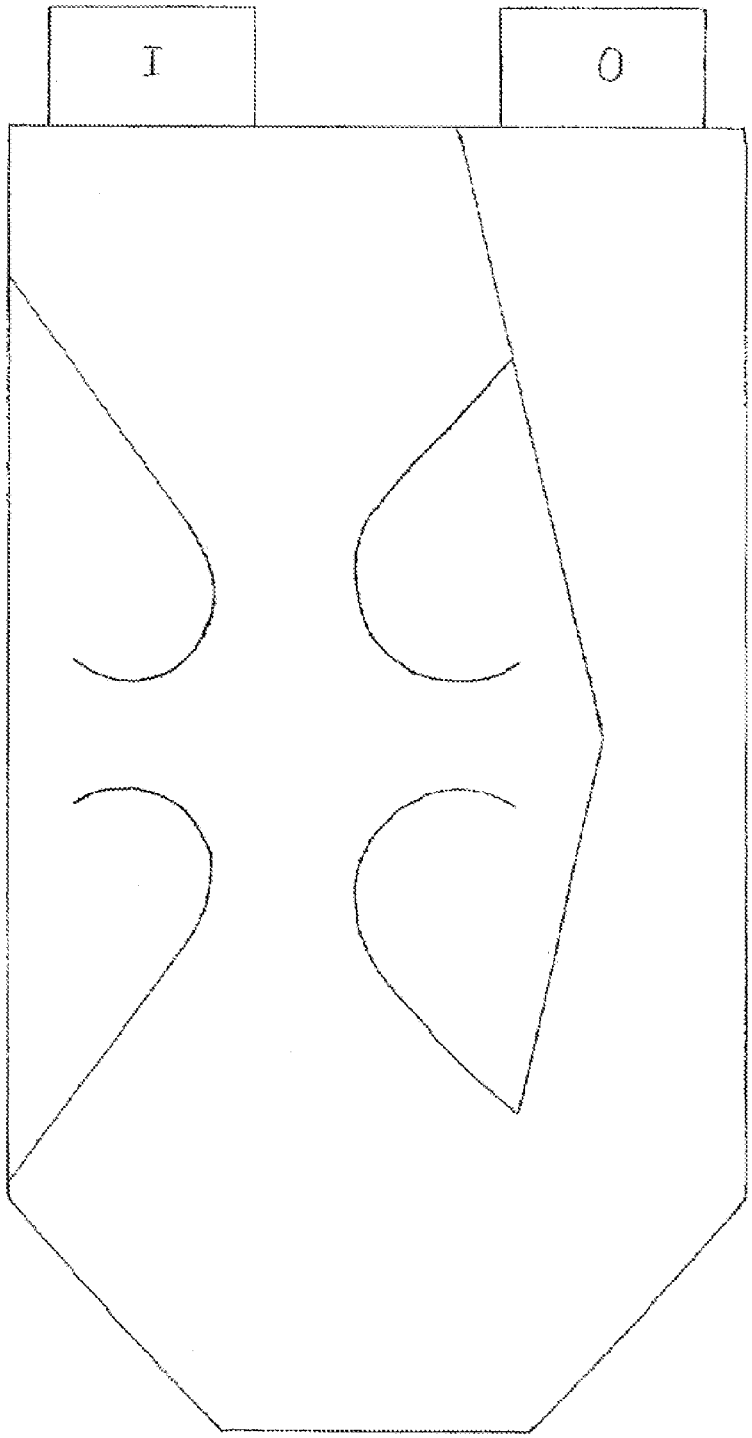
Figure 14:
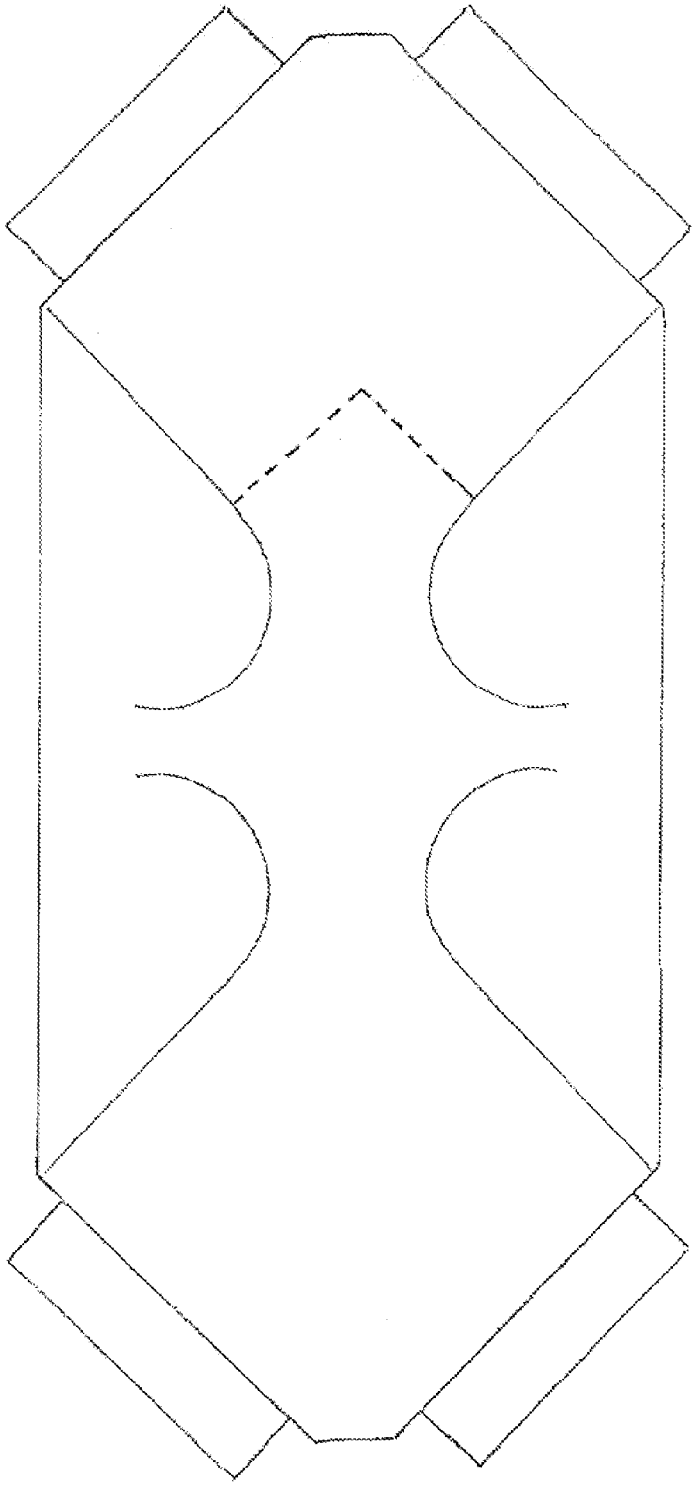
Figure 15:
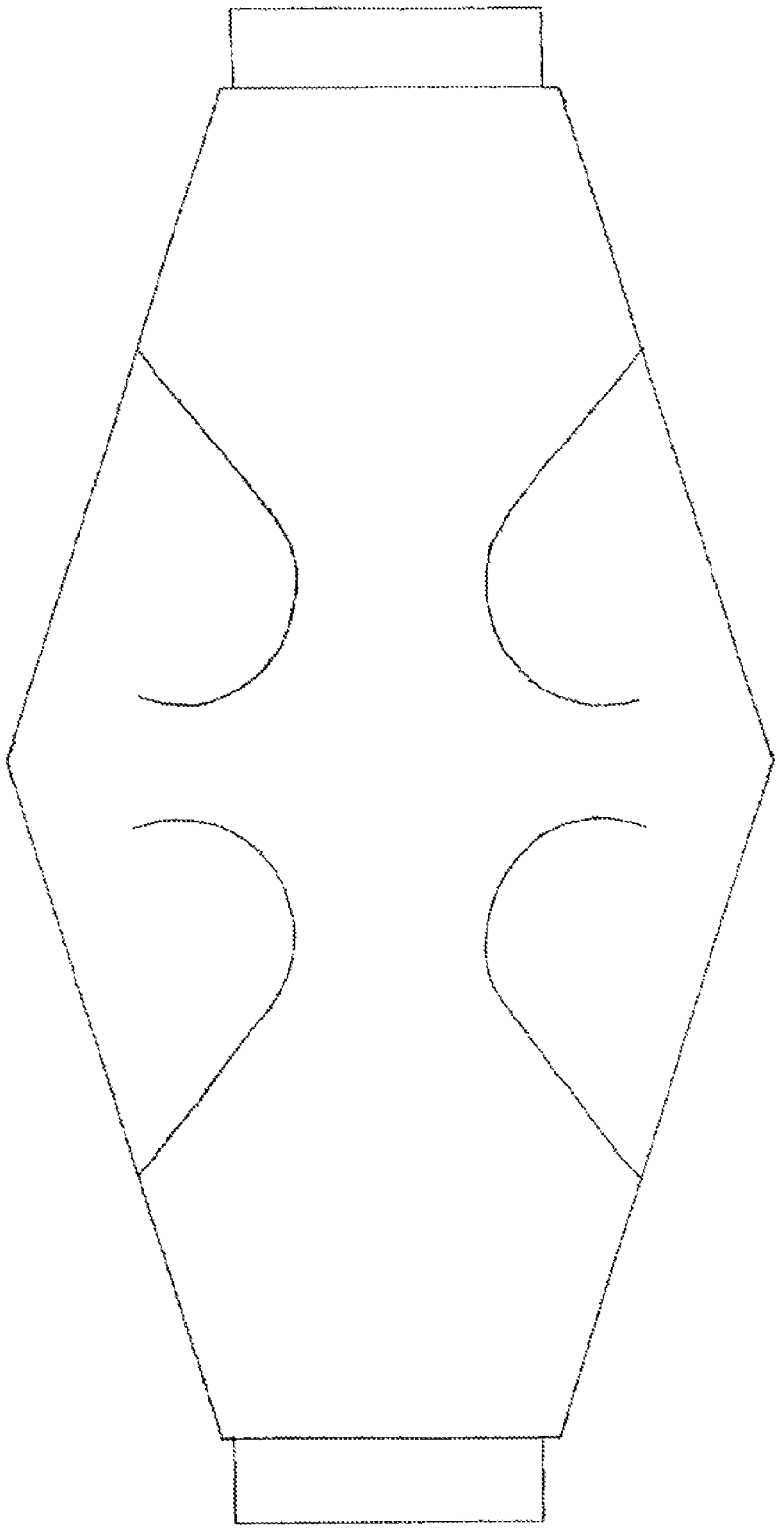
Figure 16:
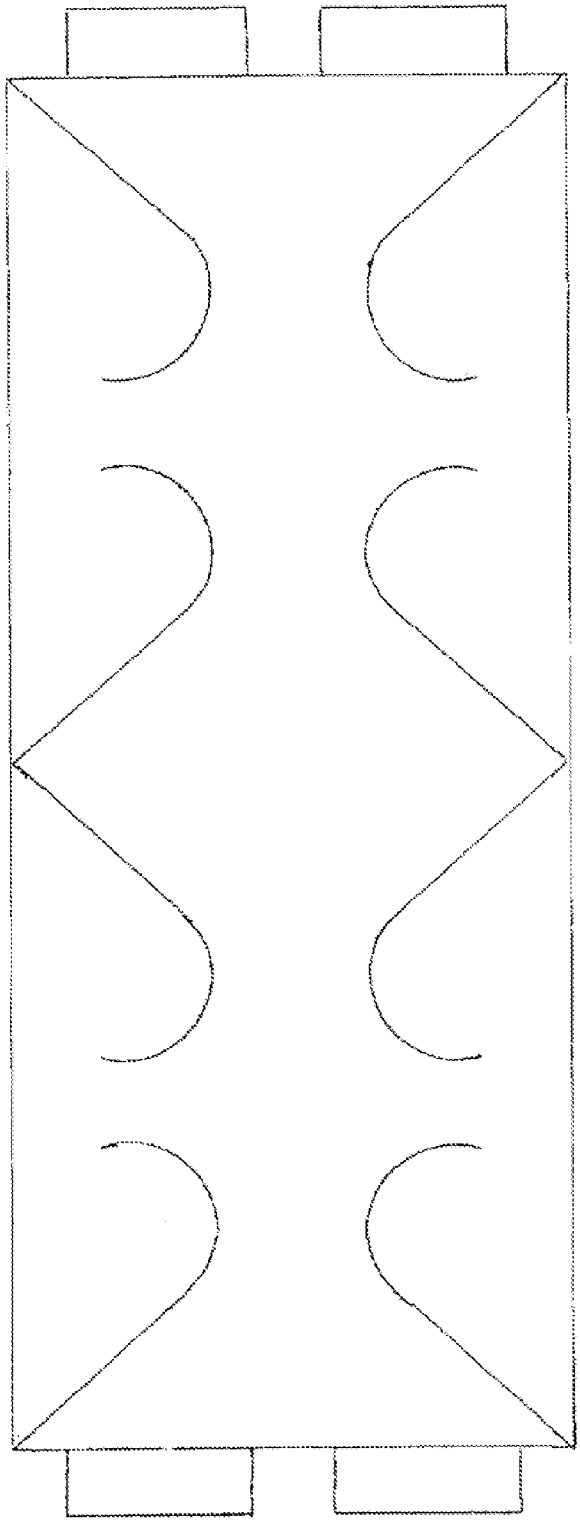
Figure 17:
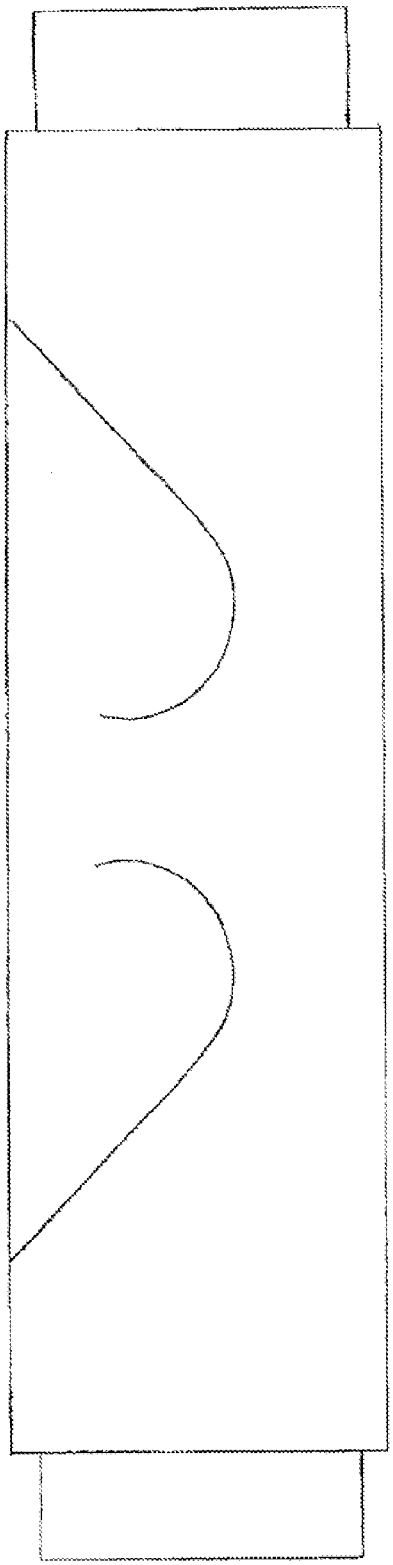
Figure 18:
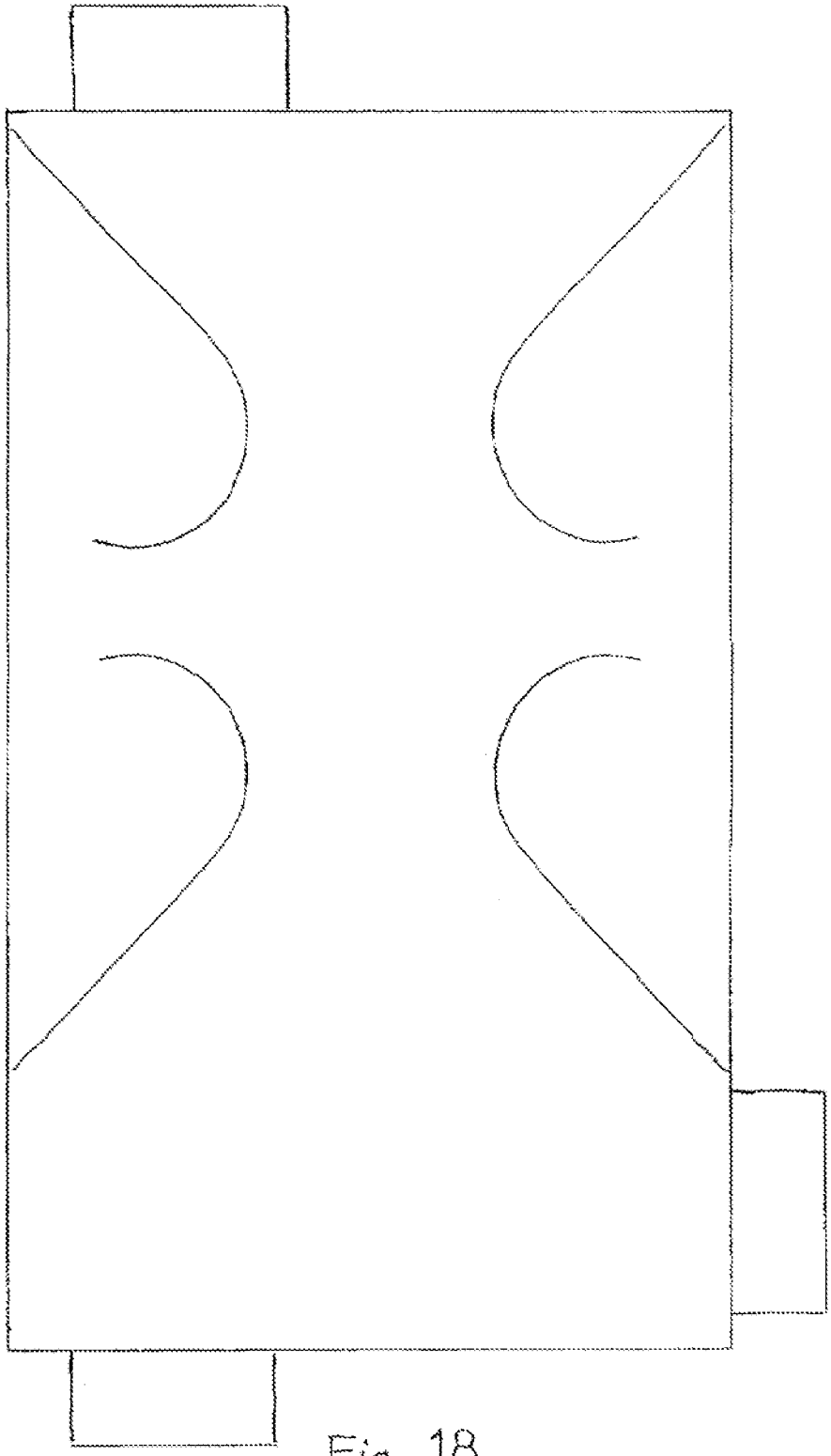
Figure 19:
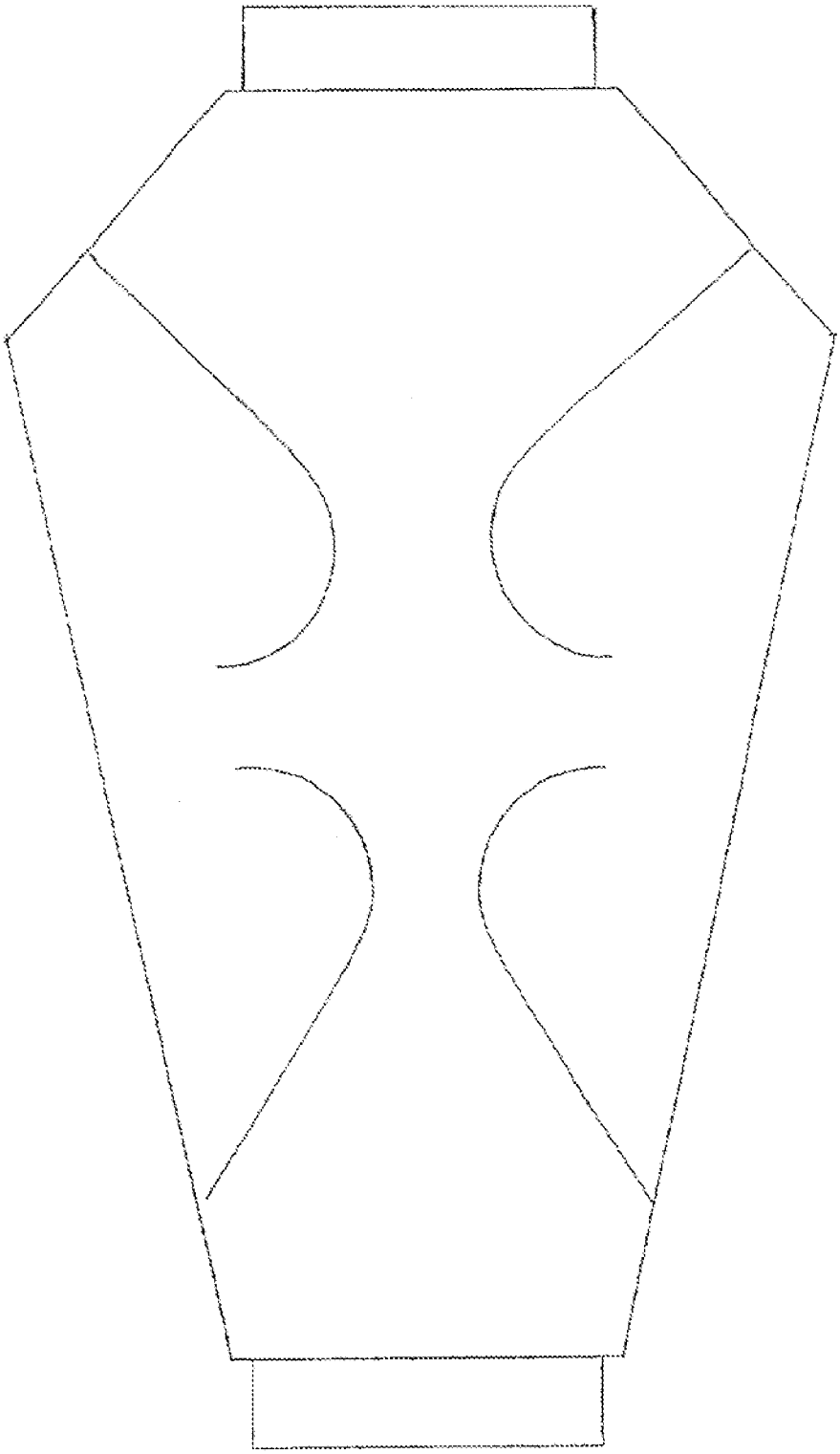
Figure 20:
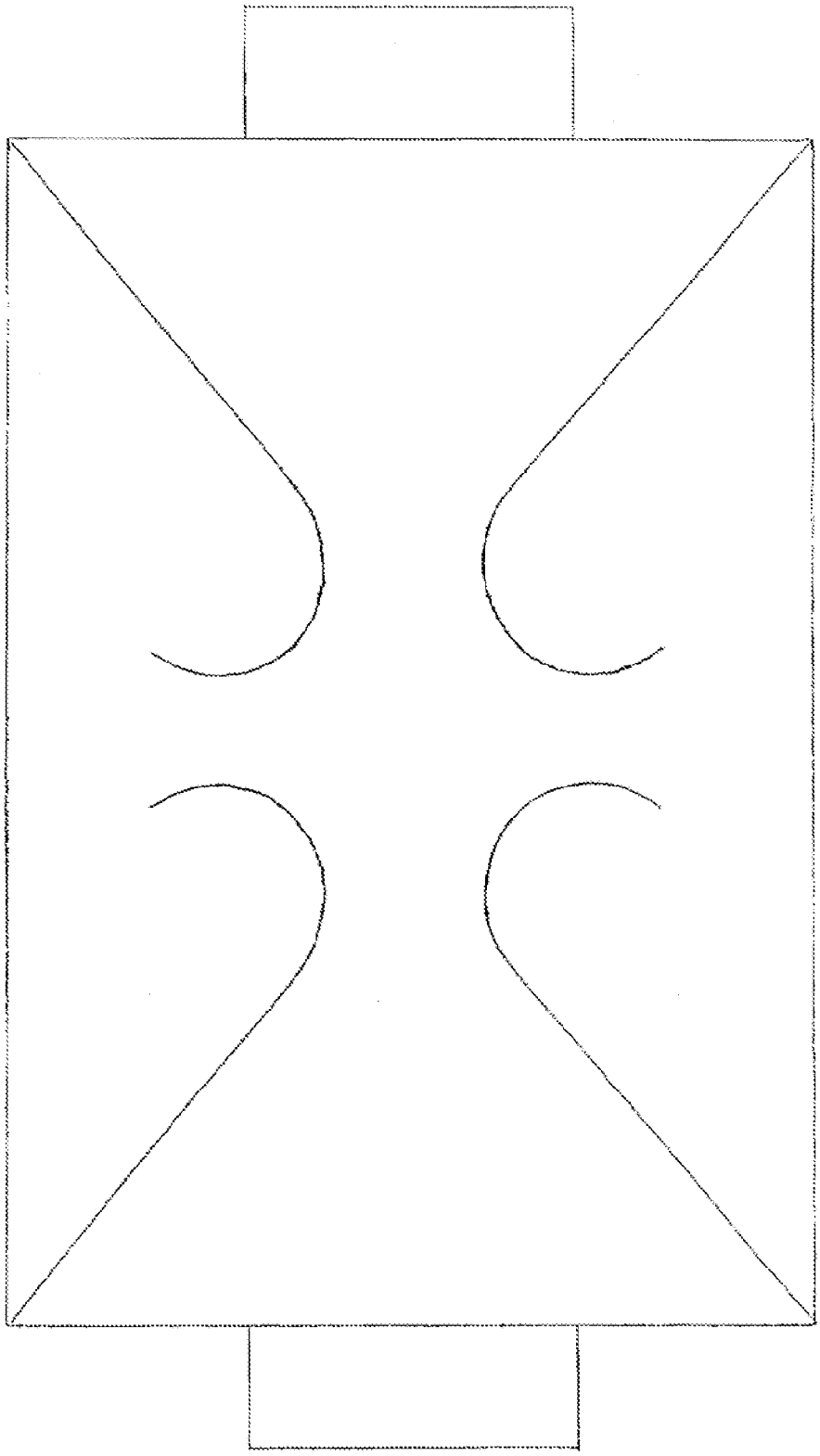

As can be seen in FIGS. 5 and 6, the exhaust exit 565 is oriented at a 45-degree angle with respect to the exhaust entry 555. Exit port 550 is configured such that the angle between flow into the entry port 540 and flow out of the exit port can be up to 90 degrees. In the illustrated embodiment, wall members 70 are positioned to form tuning chambers 410 in a manner similar to that illustrated in FIGS. 3 and 4. However, various similar embodiments may likewise include boost chambers 400 in a manner similar to that illustrated in FIGS. 3 and 4.

FIGS. 7-20 illustrate in cross-section, in a manner similar to that of FIGS. 3, 4 and 6, numerous additional embodiments of a muffler according to principles of the present invention that include corresponding inventive configurations of boost chambers 400 and tuning chambers 410 as are similarly employed by the embodiments illustrated in FIGS. 3, 4 and 6.

While the preferred embodiment of the invention has been illustrated and described, as noted above, many changes can be made without departing from the spirit and scope of the invention. For example, the entirety of muffler 10, 500, including, for example, the base members 20, 30, wall members 70 and side surfaces 40, does not include fiberglass, ceramic, or steel fibers. Accordingly, the scope of the invention is not limited by the disclosure of the preferred embodiment.

What is claimed is:

1. An exhaust muffler comprising:

a pair of base members disposed substantially parallel to one another and defining an exhaust entry and exhaust exit;

first and second wall members coupled to the base members, the first and second wall members being intermediate the base members and intermediate the entry and exit, the first and second wall members comprising linear portions coupled to semicircular portions; and at least one side surface coupled to the base members, wherein the linear portions of the first and second wall members extend from the at least one side surface in a convergent manner such that the semicircular portions of the first and second wall members are inclined toward one another, there being formed at least one chamber by cooperation of at least one of the first and second wall members, the at least one side surface and at least one of the base members.

2. An exhaust muffler comprising:

A pair of base members disposed substantially parallel to one another and defining an exhaust entry and an exhaust exit; and first and second wall members comprising linear portions coupled to semicircular portions , the linear portions being positioned in a divergent manner such that the semicircular portions are inclined away from one another so as to form with the base members, at least one chamber.

3. The muffler of claim 1, comprising third and fourth wall members of the at least one wall member, the third and fourth wall members positioned such that the semicircular portions of the third and fourth wall members are inclined away from each other to form, in cooperation with the base members, at least one chamber.

4. The muffler of claim 1, wherein the base members and at least one wall member do not comprise fiberglass, ceramic, or steel fibers.

5. The muffler of claim 1, wherein the exhaust exit is oriented at an angle with respect to the exhaust entry, the angle being within the range of 45 degrees to 90 degrees.

6. The muffler of claim 2, comprising third and fourth wall members of the at least one wall member, the third and fourth wall members positioned such that the semicircular portions of the third and fourth wall members are inclined away from each other to form, in cooperation with the base members, at least one chamber.

7. The muffler of claim 2, wherein the base members and at least one wall member do not comprise fiberglass, ceramic, or steel fibers.

8. The muffler of claim 2, wherein the exhaust exit is oriented at an angle with respect to the exhaust entry, the angle being within the range of 45 degrees to 90 degrees.

* * * * *